US009057115B2

(12) United States Patent
Pieper et al.

(10) Patent No.: US 9,057,115 B2
(45) **Date of Patent: *Jun. 16, 2015**

(54) SOFT MAGNETIC IRON-COBALT-BASED ALLOY AND PROCESS FOR MANUFACTURING IT

(75) Inventors: Witold Pieper, Gelnhausen (DE); Joachim Gerster, Alzenau (DE)

(73) Assignee: Vacuumschmelze GmbH & Co. KG, Hanau (DE)

( * ) Notice: Subject to any disclaimer, the term of this patent is extended or adjusted under 35 U.S.C. 154(b) by 1152 days.

This patent is subject to a terminal disclaimer.

(21) Appl. No.: 12/219,614

(22) Filed: Jul. 24, 2008

(65) Prior Publication Data

US 2009/0039994 A1 Feb. 12, 2009

Related U.S. Application Data

(60) Provisional application No. 60/935,147, filed on Jul. 27, 2007.

(51) Int. Cl.

| | |
|---|---|
| ***H01F 1/147*** | (2006.01) |
| ***C22C 38/10*** | (2006.01) |
| ***C21D 6/00*** | (2006.01) |
| ***C21D 8/12*** | (2006.01) |
| ***C22C 38/02*** | (2006.01) |
| ***C22C 38/06*** | (2006.01) |
| ***C22C 38/30*** | (2006.01) |
| ***H01F 41/02*** | (2006.01) |

(52) U.S. Cl.

CPC ..... *C21D 8/1272* (2013.01); *C21D 6/007* (2013.01); *C22C 38/02* (2013.01); *C22C 38/06* (2013.01); *C22C 38/30* (2013.01); *H01F 1/14791* (2013.01); *H01F 41/0206* (2013.01)

(58) Field of Classification Search

CPC ..... C21D 8/005; C22C 38/004; C22C 38/02; C22C 38/10; C22C 38/12; C22C 38/18; H01F 1/147

See application file for complete search history.

(56) References Cited

U.S. PATENT DOCUMENTS

| | | | | |
|---|---|---|---|---|
| 2,225,730 | A | | 12/1940 | Armstrong |
| 2,926,008 | A | | 2/1960 | Barnett et al. |
| 2,960,744 | A | | 11/1960 | Blank |
| 3,255,512 | A | | 6/1966 | Lochner at al. |
| 3,337,373 | A | | 8/1967 | Foster et al. |
| 3,401,035 | A | | 9/1968 | Moskowitz et al. |
| 3,502,462 | A | | 3/1970 | Dabkowski et al. |
| 3,624,568 | A | | 11/1971 | Olsen et al. |
| 3,634,072 | A | | 1/1972 | Ackemann et al. |
| 3,704,118 | A | * | 11/1972 | Stroble ..... 420/435 |
| 3,977,919 | A | | 8/1976 | Foster et al. |
| 4,059,462 | A | | 11/1977 | Masumoto et al. |
| 4,076,525 | A | | 2/1978 | Little et al. |
| 4,076,861 | A | | 2/1978 | Furukawa et al. |
| 4,120,704 | A | | 10/1978 | Anderson |
| 4,160,066 | A | | 7/1979 | Szumachowski et al. |
| 4,171,978 | A | | 10/1979 | Inoue |
| 4,201,837 | A | | 5/1980 | Lupinski |
| 4,236,919 | A | | 12/1980 | Kamino |
| 4,324,597 | A | | 4/1982 | Kamino et al. |
| 4,543,208 | A | | 9/1985 | Horie et al. |
| 4,601,765 | A | | 7/1986 | Soileau et al. |
| 4,891,079 | A | | 1/1990 | Nakajima et al. |
| 4,923,533 | A | | 5/1990 | Shigeta et al. |
| 4,950,550 | A | | 8/1990 | Radeloff et al. |
| 4,969,963 | A | | 11/1990 | Honkura et al. |
| 4,985,089 | A | | 1/1991 | Yoshizawa et al. |
| 4,994,122 | A | | 2/1991 | DeBold et al. |
| 5,069,731 | A | | 12/1991 | Yoshizawa et al. |
| 5,091,024 | A | | 2/1992 | DeBold et al. |
| 5,160,379 | A | | 11/1992 | Yoshizawa et al. |
| 5,200,002 | A | | 4/1993 | Hilzinger |
| 5,202,088 | A | | 4/1993 | Genma et al. |
| 5,252,148 | A | | 10/1993 | Shigeta et al. |
| 5,261,152 | A | | 11/1993 | Simozaki et al. |
| 5,268,044 | A | | 12/1993 | Hemphill et al. |
| 5,449,419 | A | | 9/1995 | Suzuki et al. |
| 5,501,747 | A | | 3/1996 | Masteller et al. |
| 5,509,975 | A | | 4/1996 | Kojima et al. |
| 5,522,946 | A | | 6/1996 | Tomita et al. |

(Continued)

FOREIGN PATENT DOCUMENTS

| | | |
|---|---|---|
| CH | 668331 | 12/1988 |
| CN | 1185012 A | 6/1998 |

(Continued)

OTHER PUBLICATIONS

Böhler N114 Extra; Nichtrostender Weichmagnetischer Stahl Stainless Soft Magnetic Steel; Böhler Edelstahl GMBH & Co KG; N244 DE EM-WS; 11 pgs.

Carpenter Specialty Alloys; Alloy Data, Chrome Core 8 & 8-FM Alloys and Chrome Core 12 & 12-FM Alloys; Carpenter Technology Corporation; Electronic Alloys; 12 pgs.

Sundar, R.S. et al.; Soft Magnetic FeCo alloys; alloy development, processing, and properties; International Materials Reviews, vol. 50, No. 3, pp. 157-192, 2005.

Stahlschlüssel 1958. Marbach: Verlag Stahlschlüssel Wegst GmbH, 1998, Version 2.0, ISBN 3-922599-15-X, Window "Analyse-Suche".

Yoshizawa, Y. et al.; Magnetic Properties of High $B_2$ Nanocrystalline FeCoCuNbSiB Alloys, Advanced Electronics Research Lab, Hitachi Metals, Ltd., 5200 Mikajiri Kumagaya, Japan, 0-7803-9009-1/05/ $20.00 © 2005 IEEE, BR 04.

(Continued)

*Primary Examiner* — Jie Yang
*Assistant Examiner* — Xiaowei Su
(74) *Attorney, Agent, or Firm* — Dickinson Wright PLLC

(57) ABSTRACT

A soft magnetic alloy consists essentially of 10 percent by weight≤Co≤22 percent by weight, 0 percent by weight≤V≤4 percent by weight, 1.5 percent by weight≤Cr≤5 percent by weight, 0 percent by weight<Mn<1 percent by weight, 0 percent by weight≤Mo≤1 percent by weight, 0.5 percent by weight≤Si≤1.5 percent by weight, 0.1 percent by weight≤Al≤1.0 percent by weight and the remainder iron, the content of the elements chromium and manganese and molybdenum and aluminum and silicon and vanadium being 4.0 percent by weight≤(Cr+Mn+Mo+Al+Si+V)≤9.0 percent by weight.

27 Claims, No Drawings

(56) References Cited

U.S. PATENT DOCUMENTS

| | | | |
|---|---|---|---|
| 5,522,948 | A | 6/1996 | Sawa et al. |
| 5,534,081 | A | 7/1996 | Takagi et al. |
| 5,594,397 | A | 1/1997 | Uchikoba et al. |
| 5,611,871 | A | 3/1997 | Yoshizawa et al. |
| 5,703,559 | A | 12/1997 | Emmerich et al. |
| 5,714,017 | A | 2/1998 | Tomida et al. |
| 5,725,686 | A | 3/1998 | Yoshizawa et al. |
| 5,741,373 | A | 4/1998 | Suzuki et al. |
| 5,741,374 | A | 4/1998 | Li |
| 5,762,967 | A | 6/1998 | Sagawa et al. |
| 5,769,974 | A | 6/1998 | Masteller et al. |
| 5,783,145 | A | 7/1998 | Coutu et al. |
| 5,804,282 | A | 9/1998 | Watanabe et al. |
| 5,817,191 | A | 10/1998 | Emmerich et al. |
| 5,911,840 | A | 6/1999 | Couderchon et al. |
| 5,914,088 | A | 6/1999 | Rao et al. |
| 5,922,143 | A | 7/1999 | Verin et al. |
| 5,976,274 | A | 11/1999 | Inoue et al. |
| 6,106,376 | A | 8/2000 | Rybak et al. |
| 6,118,365 | A | 9/2000 | Petzold et al. |
| 6,146,474 | A | 11/2000 | Coutu et al. |
| 6,168,095 | B1 | 1/2001 | Seitter et al. |
| 6,171,408 | B1 | 1/2001 | Herzer et al. |
| 6,181,509 | B1 | 1/2001 | Canlas et al. |
| 6,270,592 | B1 | 8/2001 | Nakajima et al. |
| 6,373,368 | B1 | 4/2002 | Shikama et al. |
| 6,392,525 | B1 | 5/2002 | Kato et al. |
| 6,425,960 | B1 | 7/2002 | Yoshizawa et al. |
| 6,462,456 | B1 | 10/2002 | DeCristofaro et al. |
| 6,478,889 | B2 | 11/2002 | Kanekiyo et al. |
| 6,507,262 | B1 | 1/2003 | Otte et al. |
| 6,563,411 | B1 | 5/2003 | Otte et al. |
| 6,588,093 | B1 | 7/2003 | Emmerich et al. |
| 6,616,125 | B2 | 9/2003 | Brown et al. |
| 6,668,444 | B2 | 12/2003 | Ngo et al. |
| 6,685,882 | B2 | 2/2004 | Deevi et al. |
| 6,710,692 | B2 | 3/2004 | Kato et al. |
| 6,749,767 | B2 | 6/2004 | Mitani et al. |
| 6,750,723 | B2 | 6/2004 | Yoshida et al. |
| 6,791,445 | B2 | 9/2004 | Shibata et al. |
| 6,814,776 | B2 | 11/2004 | Kanekiyo et al. |
| 6,827,557 | B2 | 12/2004 | Kim |
| 6,942,741 | B2 | 9/2005 | Shimao et al. |
| 6,946,097 | B2 | 9/2005 | Deevi et al. |
| 6,962,144 | B2 | 11/2005 | Chretien et al. |
| 7,128,790 | B2 | 10/2006 | Waeckerle et al. |
| 7,172,660 | B2 | 2/2007 | Song et al. |
| 7,175,717 | B2 | 2/2007 | Song et al. |
| 7,442,263 | B2 | 10/2008 | Günther et al. |
| 7,532,099 | B2 | 5/2009 | Brunner |
| 7,563,331 | B2 | 7/2009 | Petzold et al. |
| 2001/0015239 | A1 | 8/2001 | Kanekiyo |
| 2001/0031837 | A1 | 10/2001 | Perez et al. |
| 2002/0062885 | A1 | 5/2002 | Li |
| 2002/0124914 | A1 | 9/2002 | Kim |
| 2002/0158540 | A1 | 10/2002 | Lindquist et al. |
| 2003/0020579 | A1 | 1/2003 | Ngo et al. |
| 2003/0034091 | A1 | 2/2003 | Shimao et al. |
| 2004/0027220 | A1 | 2/2004 | Günther et al. |
| 2004/0079449 | A1 | 4/2004 | Kanekiyo et al. |
| 2004/0089377 | A1 | 5/2004 | Deevi et al. |
| 2004/0099347 | A1 | 5/2004 | Waeckerle et al. |
| 2004/0112468 | A1 | 6/2004 | Petzold et al. |
| 2004/0183643 | A1 | 9/2004 | Brunner |
| 2005/0017587 | A1 | 1/2005 | Koenig |
| 2005/0028889 | A1 | 2/2005 | Song et al. |
| 2005/0034787 | A1 | 2/2005 | Song et al. |
| 2005/0236071 | A1 | 10/2005 | Koshiba et al. |
| 2005/0268994 | A1 | 12/2005 | Gerster et al. |
| 2007/0029013 | A1 | 2/2007 | Waeckerle et al. |
| 2007/0176025 | A1 | 8/2007 | Gerster |
| 2008/0042505 | A1 | 2/2008 | Gerster et al. |
| 2008/0099106 | A1 | 5/2008 | Pieper et al. |
| 2008/0136570 | A1 | 6/2008 | Gerster |
| 2009/0145522 | A9 | 6/2009 | Pieper et al. |
| 2009/0184790 | A1 | 7/2009 | Pieper et al. |
| 2009/0206975 | A1 | 8/2009 | Nuetzel et al. |
| 2009/0320961 | A1 | 12/2009 | Brunner |
| 2010/0018610 | A1 | 1/2010 | Petzold et al. |
| 2010/0194507 | A1 | 8/2010 | Brunner |

FOREIGN PATENT DOCUMENTS

| | | | |
|---|---|---|---|
| DE | 694374 | | 7/1940 |
| DE | 1740491 | | 12/1956 |
| DE | 2816173 | | 10/1979 |
| DE | 3324729 | | 1/1984 |
| DE | 3237183 | | 4/1984 |
| DE | 3427716 | | 11/1985 |
| DE | 3542257 | | 6/1987 |
| DE | 4030791 | A1 | 8/1991 |
| DE | 4442420 | A1 | 5/1996 |
| DE | 69714103 | T2 | 9/1997 |
| DE | 19635257 | | 3/1998 |
| DE | 69810551 | T2 | 3/1999 |
| DE | 19844132 | | 4/1999 |
| DE | 19818198 | | 10/1999 |
| DE | 19908374 | A1 | 9/2000 |
| DE | 19928764 | A1 | 1/2001 |
| DE | 69611610 | | 7/2001 |
| DE | 10024824 | | 11/2001 |
| DE | 10031923 | A1 | 1/2002 |
| DE | 69903202 | | 6/2003 |
| DE | 69528272 | | 7/2003 |
| DE | 10211511 | | 10/2003 |
| DE | 10320350 | | 9/2004 |
| DE | 103 48 808 | B4 | 3/2005 |
| DE | 103 48 810 | A1 | 3/2005 |
| DE | 602 05 728 | T2 | 3/2006 |
| DE | 102006055088 | B4 | 6/2008 |
| EP | 0216457 | A1 | 4/1987 |
| EP | 0299498 | | 1/1989 |
| EP | 0 302 355 | A1 | 2/1989 |
| EP | 0429022 | | 5/1991 |
| EP | 0271657 | | 5/1992 |
| EP | 0 502 397 | A2 | 9/1992 |
| EP | 0635853 | | 1/1995 |
| EP | 0637038 | | 2/1995 |
| EP | 0435680 | B1 | 4/1995 |
| EP | 0715320 | A1 | 6/1996 |
| EP | 0794541 | A1 | 9/1997 |
| EP | 0824755 | B1 | 2/1998 |
| EP | 0899 753 | B1 | 3/1999 |
| EP | 0 936 638 | A2 | 8/1999 |
| EP | 1124999 | A1 | 8/2001 |
| EP | 0771466 | B1 | 9/2002 |
| EP | 1 371 434 | B1 | 12/2003 |
| EP | 1475450 | A1 | 11/2004 |
| EP | 1503486 | | 2/2005 |
| GB | 833446 | | 4/1960 |
| GB | 1369844 | | 10/1974 |
| JP | 51092097 | A | 2/1975 |
| JP | 54006808 | A | 6/1977 |
| JP | 59058813 | A | 4/1984 |
| JP | 59177902 | | 10/1984 |
| JP | 61058450 | | 3/1986 |
| JP | 61253348 | A | 11/1986 |
| JP | 6293342 | A | 4/1987 |
| JP | 62093342 | A | 4/1987 |
| JP | 63-21807 | | 1/1988 |
| JP | 1247557 | A | 3/1989 |
| JP | 02301544 | | 12/1990 |
| JP | 03-019307 | | 1/1991 |
| JP | 03-146615 | | 6/1991 |
| JP | 4-048005 | A | 2/1992 |
| JP | 05-283238 | | 10/1993 |
| JP | 05283238 | | 10/1993 |
| JP | 05-299232 | | 11/1993 |
| JP | 6033199 | A | 2/1994 |
| JP | 6-176921 | A | 6/1994 |
| JP | 06-224023 | | 8/1994 |
| JP | 08-246109 | | 9/1996 |
| JP | 63021807 | | 1/1998 |
| JP | 10-092623 | | 4/1998 |

(56) References Cited

FOREIGN PATENT DOCUMENTS

| | | | |
|---|---|---|---|
| JP | 10-097913 | | 4/1998 |
| JP | 10-208923 | | 8/1998 |
| JP | 2000-182845 | | 6/2000 |
| JP | 2000-277357 | A | 10/2000 |
| JP | 2001-068324 | | 3/2001 |
| JP | 2002294408 | A | 3/2001 |
| JP | 2004-349585 | | 12/2004 |
| JP | 2006-193779 | * | 7/2006 |
| JP | 2006193779 | A | 7/2006 |
| JP | 2006322057 | A | 11/2006 |
| JP | 2006-336061 | * | 12/2006 |
| JP | 2007113148 | | 5/2007 |
| SU | 338550 | | 5/1972 |
| SU | 1062298 | A1 | 7/1982 |
| WO | WO 96/19001 | | 6/1996 |
| WO | WO 00/25326 | | 5/2000 |
| WO | WO 00/28556 | | 5/2000 |
| WO | WO 0100895 | A1 | 1/2001 |
| WO | WO 01/86665 | A1 | 11/2001 |
| WO | WO 02/055749 | | 7/2002 |
| WO | WO 03/003385 | | 1/2003 |
| WO | WO 03/007316 | A2 | 1/2003 |
| WO | WO 03/088281 | A1 | 10/2003 |
| WO | WO 2007/088513 | | 8/2007 |

OTHER PUBLICATIONS

Non-Final Office Action dated Sep. 29, 2008 for U.S. Appl. No. 11/343,558.

Non-Final Office Action dated Apr. 6, 2009 for U.S. Appl. No. 11/343,558.

E. Wolfarth: "Ferromagnetic Materials vol. 2,"—Soft Magnetic Metallic Materials—p. 73 (1980).

Examination Report dated Sep. 24, 2009 for European Publication No. 02 745 429.7-2208 (English Translation and Certificate of Translation dated Dec. 30, 2010).

Non-Final Office Acion dated Apr. 1, 2010 for U.S. Appl. No. 11/343,558.

Final Office Acion dated Oct. 15, 2010 for U.S. Appl. No. 11/343,558.

Non-Final Office Action dated Aug. 31, 2010 for U.S. Appl. No. 11/878,856.

Restriction Requirement dated Nov. 4, 2009 for U.S. Appl. No. 11/878,856.

Non-Final Office Action dated Mar. 22, 2010 for U.S. Appl. No. 11/878,856.

Restriction Requirement dated Sep. 22, 2010 for U.S. Appl. No. 12/219,615.

Restriction Requirement dated Apr. 26, 2010 for U.S. Appl. No. 12/486,528.

Non-Final Office Action dated Jul. 27, 2010 for U.S. Appl. No. 12/486,528.

Non-Final Office Action dated Dec. 13, 2010 for U.S. Appl. No. 12/219,615.

Witold Pieper et al., "Soft Magnetic Iron—Cobalt Based Alloy and Method for Its Production", German Application No. DE 10 2006 051 715.6, International Filing Date Oct. 30, 2006, U.S. Appl. No. 11/878,856, filed Jul. 27, 2007.

Major and Orrock, "High Saturation Ternary Cobalt—Iron Based Alloys," IEEE Transactions on Magnetics, vol. 24, No. 2, Mar. 1988, pp. 1856-1858.

D. Grätzer et al., "Transduktor in Schaltnetzteilen", VAC trade literature TB-410-1 Vacummschmelze GmbH, Hanau, Germany, May 1998.

E. Wolfarth: "Ferromagnetic Materials vol. 2," p. 73 (1980).

R. McCurrie, "Ferromagnetic Materials Structure and Properties," Academic Press, pp. 77-78 (1994).

A. Taub, "Effect of the heating rate used during stress relief annealing on the magnetic properties of amorphous alloys," J. Appl. Phys. 55, No. 6, Mar. 15, 1984, pp. 1775-1777.

Abstract of Japanese Patent Publication No. 2000277357, Oct. 6, 2000.

Abstract of Japanese Patent Publication No. 59058813, Apr. 4, 1984.

ASM Materials Engineering Dictionary, Edited by J.R. Davis, Davis & Associates, 1992, p. 2002.

Liu Junxin et Yuqin Qiu: "Heat Treating Method of Nanocrystalline Current Transformer Core".

First Office Action mailed Jan. 7, 2005 issued by the Chinese Patent Office for Chinese Patent Application No. 02809188.4.

J. Wünning: "Die Wärmebehandlung in der Fertigungslinie mit einem neuartigen Rollenherdofen," HTM Härterei—Technische Mitteilungen 45 Nov./Dec. 1990, No. 6, pp. 325-329 XP 163038.

Examination Report dated Sep. 24, 2009 for European Publication No. 02 745 429.7-2208.

Liu Junxin et Yuqin Qiu: "Heat Treating Method of Nanocrystalline Current Transformer Core" (English Translation and Certificate of Translation dated Nov. 23, 2009).

German Patent Publication No. 694374 (English Translation and Certificate of Translation dated Nov. 23, 2009).

Chinese Patent Publication No. CN1185012A (English Translation and Certificate of Translation dated Nov. 23, 2009).

Non-Final Office Action dated Jun. 11, 2009 for U.S. Appl. No. 11/663,271.

Non-Final Office Action dated Sep. 22, 2009 for U.S. Appl. No. 11/663,271.

Final Office Action dated Oct. 30, 2009 for U.S. Appl. No. 11/343,558.

Office Action dated Apr. 22, 2010 for German Patent Application No. 10 2009 038 730.7-24 and English Translation of the same.

H. Reinboth, "Technologie und Anwendung magnetischer Werkstoffe," Veb Verlag Technik, p. 230 (1969) (English Translation and Certificate of Translation dated Nov. 23, 2009).

Examination Report dated Feb. 26, 2003 for German Patent Publication No. 101 34 056.7-33 (English Translation and Certificate of Translation dated Nov. 23, 2009).

Cahn, R.W., et al, "Materials Science and Technology—A Comprehensive Treatment", Wiley-VCH, vol. 6/7, Constitution and Properties of Steels—vol. Editor: F.P. Pickering, p. 47, 2005.

Cahn, R.W., et al, "Materials Science and Technology—A Comprehensive Treatment", Wiley-VCH, vol. 6/7, Constitution and Properties of Steels—vol. Editor: F.P. Pickering, p. 54, 2005.

Kneller, E., et al., "Ferromagnetismus", Springer Verlag, 1962, p. 149 and p. 262.

Leslie, W.C., "Iron and Its Dilute Substitutional Solid Solutions", Metallurgical Transactions, vol. 3, Jan. 1972, pp. 5-26.

Massalski, T.B., "Binary Alloy Phase Diagrams", American Society for Metals, 1986, pp. 761-765.

* cited by examiner

SOFT MAGNETIC IRON-COBALT-BASED ALLOY AND PROCESS FOR MANUFACTURING IT

This application claims benefit of the filing date of U.S. Provisional Application Ser. No. 60/935,147, filed Jul. 27, 2007, the entire contents of which are incorporated herein by reference.

BACKGROUND

1. Field

Disclosed herein are soft magnetic iron-cobalt-based alloys and to processes for manufacturing the alloy and processes for manufacturing semi-finished products from the alloy, in particular magnetic components for actuator systems. The alloys desirably have a cobalt content of 10 to 22 percent by weight, 2. Description of Related Art Soft magnetic iron-cobalt-based alloys often have a high saturation magnetisation and can therefore be used to develop electromagnetic actuator systems with high forces and/or small dimensions. These alloys can be used in solenoid valves such as solenoid valves for fuel injection systems in internal combustion engines, for example.

Certain soft magnetic iron-cobalt-based alloys with a cobalt content of 10 to 22 percent by weight are disclosed, for example, in U.S. Pat. No. 7,128,790. When these alloys are used in fast-switching actuators it is possible that the switching frequency of the actuators is limited due to the eddy currents which occur in the alloy. Moreover, improvements in the strength of the magnet cores used in continuous operation in high frequency actuator systems are also desired.

SUMMARY

One object of the invention disclosed herein is, therefore, to provide an alloy which is better suited to use as a soft magnetic core in fast-switching actuators.

This object is achieved in the invention by means of the subject matter disclosed herein.

In one embodiment, the invention relates to a soft magnetic alloy that consists essentially of 10 percent by weight≤Co≤22 percent by weight, 0 percent by weight≤V≤4 percent by weight, 1.5 percent by weight≤Cr≤5 percent by weight, 0 percent by weight<Mn<1 percent by weight, 0 percent by weight≤Mo≤1 percent by weight, 0.5 percent by weight≤Si≤1.5 percent by weight, 0.1 percent by weight≤Al≤1.0 percent by weight and the remainder iron, the content of the elements chromium and manganese and molybdenum and aluminium and silicon and vanadium being 4.0 percent by weight≤(Cr+Mn+Mo+Al+Si+V)≤9.0 percent by weight.

In another embodiment is disclosed a soft magnetic core or flow conductor for an electromagnetic actuator made of an alloy in accordance with one of the preceding embodiments. In various different embodiments this soft magnetic core is a soft magnetic core for a solenoid valve of an internal combustion engine, a soft magnetic core for a fuel injection valve of an internal combustion engine, a soft magnetic core for a direct fuel injection valve of a spark ignition engine or a diesel engine and a soft magnetic component for electromagnetic valve adjustment such as an inlet/outlet valve.

In another embodiment is disclosed a fuel injection valve of an internal combustion engine with a component made of a soft magnetic alloy in accordance with one of the preceding embodiments. In further embodiments the fuel injection valve is a direct fuel injection valve of a spark ignition engine and a direct fuel injection valve of a diesel engine.

In further embodiments are disclosed a return part for an electromagnetic actuator and a soft magnetic rotor and stator for an electric motor made of an alloy in accordance with one of the preceding embodiments.

In another embodiment is disclosed a process for manufacturing semi-finished products from a cobalt-iron alloy in which workpieces are manufactured initially by melting and hot forming a soft magnetic alloy which consists essentially of 10 percent by weight≤Co≤22 percent by weight, 0 percent by weight 5. V≤4 percent by weight, 1.5 percent by weight≤Cr≤5 percent by weight, 0 percent by weight<Mn<1 percent by weight, 0 percent by weight≤Mo≤1 percent by weight, 0.5 percent by weight≤Si≤1.5 percent by weight, 0.1 percent by weight≤Al≤1.0 percent by weight and the remainder iron, the content of the elements chromium and manganese and molybdenum and aluminium and silicon and vanadium being 4.0 percent by weight≤(Cr+Mn+Mo+Al+Si+V)≤9.0 percent by weight. A final annealing process is then carried out.

DETAILED DESCRIPTION OF SPECIFIC EMBODIMENTS

The term "essentially" indicates the inclusion of incidental impurities such that they do not affect the basis and novel characteristics of the alloy or devices made therefrom. The alloy preferably has a maximum of 200 ppm nitrogen, a maximum of 400 ppm carbon and a maximum of 100 ppm oxygen.

As used herein, the term "return part" refers to a general magnetic part for guiding, concentrating, or providing a path, e.g., a low reluctance path, for a magnetic flux. Such elements typically are used as parts of a magnetic circuit. A non-limiting example of a return part would be a magnetic yoke or pole piece.

The alloy disclosed herein has a higher specific resistivity than the binary Co—Fe alloy leading to the suppression of eddy currents, the saturation polarisation being reduced as little as possible while at the same time the coercive field strength $H_c$ is increased as little as possible. Without wishing to be bound by theory, it is believed that this is achieved by the addition by alloying of the non-magnetic elements, in particular of the elements chromium and manganese and molybdenum and aluminium and silicon and vanadium in the content disclosed in the invention which lies between 4.0 and 9.0 percent by weight.

Cr and Mn provide a strong increase in resistivity at a low reduction in saturation. At the same time the annealing temperature corresponding to the upper boundary of the ferritic phase is lowered. This latter effect is not, however, desired since it leads to poorer soft magnetic properties. Desirably, the Mn content is such that 0.4 percent by weight<Mn<1.0 percent by weight.

Al, V and Si also increase the electrical resistivity whilst at the same time raising the annealing temperature. Thus, by including one or more of them in the disclosed amount it is possible to specify an alloy with high resistivity, high saturation and a high annealing temperature and thus with good soft magnetic properties.

Moreover, due to its Al and Si contents, the alloy disclosed herein has greater strength. The alloy is cold formable and ductile in its fully annealed state. An elongation value of $A_L$>2% or $A_L$>20% is measured in tensile tests. This alloy is suitable for use as a magnet core in a fast-acting actuator system such as a fuel injection valve of an internal combustion engine.

The requirements demanded of a soft magnetic cobalt-iron-based alloy for an actuator system are contradictory. In the binary alloy a higher cobalt content leads to a high saturation magnetisation $J_s$ of approximately 9 mT per 1 percent by weight Co (starting from 17 percent by weight Co) and thus permits smaller dimensions and greater system integration or higher actuator forces with the same dimensions. At the same time, however, the costs of the alloy increase with increasing cobalt content. In addition, as the Co percentage increases, soft magnetic properties such as permeability, for example, deteriorate. Above a cobalt content of 22 percent by weight, the increase in saturation due to the addition by alloying of further Co is less.

The alloy should also have a high specific electrical resistivity and good soft magnetic properties.

The alloy disclosed herein, therefore, has a cobalt content of 10 percent by weight≤Co≤22 percent by weight. A cobalt content in this range reduces the raw materials cost of the alloy, thereby making it suitable for applications subject to high cost pressure such as those in the automotive sector, for example. Maximum permeability is high within this range, leading to more favourable lower driver currents when used as an actuator.

In more particular embodiments, the alloy has a cobalt content of 14 percent by weight≤Co≤22 percent by weight, and 14 percent by weight≤Co≤20 percent by weight.

The soft magnetic alloy of the magnet core has chromium and manganese contents which lead to a higher specific electrical resistivity p in the annealed state with lower saturation reduction. This higher specific resistivity permits shorter switching times in an actuator, since eddy currents are reduced. At the same time, the alloy has high saturation and high permeability $\mu_{max}$ and therefore retains good soft magnetic properties.

The elements Si and Al in the alloy provide improved alloy strength without substantially reducing its soft magnetic properties. Due to the addition by alloying of Si and Al, it is possible to significantly increase the strength of the alloy by solid solution hardening without a significant reduction in magnetic properties.

The aluminium and vanadium contents disclosed in the invention permit a higher annealing temperature, which leads to good soft magnetic properties of the coercive field strength $H_c$ and maximum permeability $\mu_{max}$. High permeability is desired since it leads to low drive currents when the alloy is used as a magnet core or a flow conductor of an actuator.

In a particular embodiment, the alloy has silicon content of 0.5 percent by weight≤Si≤1.0 percent by weight.

The Mo content has been kept relatively low in order to prevent the formation of carbides, which could lead to a reduction in magnetic properties. Desirably, the Mo content is such that 0 percent by weight<Mo<0.5 percent by weight.

In addition to Cr and Mn, a small molybdenum content is also favourable since it is generally provides a good ratio of increase in resistivity to reduction in saturation.

In a particular embodiment, the aluminium and silicon content is 0.6 percent by weight≤Al+Si≤2 percent by weight, more particularly 0.6 percent by weight≤Al+Si≤1.5 percent by weight. This helps to avoid the brittleness and processing problems which can occur with high combined aluminium and silicon contents.

In particular embodiment the content of chromium and manganese and molybdenum and aluminium and silicon and vanadium is 6.0 percent by weight≤Cr+Mn+Mo+Al+Si+V≤9.0 percent by weight.

Alloys with the aforementioned compositions can have a specific electrical resistivity of ρ>0.50 μΩm or ρ>0.55 μΩm or ρ>0.60 μΩm or ρ>0.65 μΩm. These values provide an alloy which, when used as a magnet core of an actuator system, produces lower eddy currents. This permits the use of the alloy in actuator systems with fast switching times.

The percentage of the elements aluminium and silicon in the alloy disclosed in the invention produces an alloy with a yield strength of $R_{p0.2}$>340 MPa. This higher alloy strength is able to lengthen the service life of the alloy when used as a magnet core of an actuator system. This is attractive when the alloy is used in high frequency actuator systems such as fuel injection valves in internal combustion engines.

The alloy disclosed in the invention has good soft magnetic properties and good strength and a high specific electrical resistivity. In further embodiments the alloy has a saturation of J(400 A/cm)>1.00 T or >2.0 T and/or a coercive field strength $H_c$ of <3.5 A/cm or $H_c$<2.0 A/cm or $H_c$<1.0 A/cm and/or a maximum permeability $\mu_{max}$>1000 or $\mu_{max}$>2000.

The content of chromium and manganese and molybdenum and aluminium and silicon and vanadium disclosed in the invention lies between 4.0 percent by weight and 9.0 percent by weight. Due to this high content, it is possible to provide an alloy which has a higher electrical resistivity of ρ>0.6 μΩm and a low coercive field strength $H_c$ of <2.0 A/cm. This combination of properties is particularly suitable for use in fast-switching actuators.

The various actuator systems such as solenoid valves and fuel injection valves have different requirements in terms of strength and magnetic properties. The requirements can be met by selecting an alloy with a composition which lies within the aforementioned ranges.

The alloy disclosed herein can be melted by means of various different processes. All current techniques including air melting and Vacuum Induction Melting (VIM), for example, are possible in theory. In addition, an arc furnace or inductive techniques may also be used. Treatment by Vacuum Oxygen Decarburization (VOD) or Argon Oxygen Decarburization (AOD) or Electro Slag Remelting (ESR) improves the quality of the product.

The VIM process is the preferred process for manufacturing the alloy since using this process it is on one hand possible to set the contents of the alloy elements more precisely and on the other easier to avoid non-metallic inclusions in the solidified alloy.

Depending on the semi-finished products to be manufactured, the melting process is followed by a range of different process steps.

If strips are to be manufactured for subsequent pressing into parts, the ingot produced in the melting process is formed by blooming into a slab ingot. Blooming refers to the forming of the ingot into a slab ingot with a rectangular cross section by a hot rolling process at a temperature of 1250° C., for example. After blooming, any scale formed on the surface of the slab ingot is removed by grinding. Grinding is followed by a further hot rolling process by means of which the slab ingot is formed into a strip at a temperature of 1250° C., for example. Any impurities which have formed on the surface of the strip during hot rolling are then removed by grinding or pickling, and the strip is formed to its final thickness which may be within a range of 0.1 mm to 0.2 mm by cold rolling. Ultimately, the strip is subjected to a final annealing process. During this final annealing any lattice imperfections produced during the various forming processes are removed and crystal grains are formed in the structure.

The manufacturing process for producing turned parts is similar. Here, too, the ingot is bloomed to produce billets of quadratic cross-section. On this occasion, the so-called blooming process takes place at a temperature of 1250° C., for example. The scale produced during blooming is then removed by grinding. This is followed by a further hot rolling process in which the billets are formed into rods or wires with a diameter of up to 13 mm, for example. Faults in the material are then corrected and any impurities formed on the surface during the hot rolling process removed by planishing and pre-turning. In this case, too, the material is then subjected to a final annealing process.

The final annealing process can be carried out within a temperature range of 700° C. to 1100° C. In a particular embodiment, final annealing is carried out within a temperature range of 750° C. to 850° C. The final annealing process may be carried out in inert gas, in hydrogen or in a vacuum.

Conditions such as the temperature and duration of final annealing can be selected such that after final annealing the alloy has deformation parameters under tensile testing including an elongation at rupture value of >2% or $A_L$>20%. In a further embodiment the alloy is cold formed prior to final annealing.

The invention having been described by reference to certain of its specific embodiments, it will be recognized that departures from these embodiments can be made within the spirit and scope of the invention, and that these specific embodiments are not limiting of the appended claims.

What is claimed is:

1. A soft magnetic core for an electromagnetic actuator comprising a soft magnetic alloy consisting essentially of:

an amount of cobalt Co, such that 10 percent by weight≤Co≤22 percent by weight, optionally an amount of vanadium V, such that 0 percent by weight≤V≤4 percent by weight, an amount of chromium Cr, such that 1.5 percent by weight≤Cr≤5 percent by weight, an amount of manganese Mn, such that 0.4 percent by weight≤Mn≤1 percent by weight, optionally an amount of molybdenum Mo, such that 0 percent by weight≤Mo≤1 percent by weight, an amount of silicon Si, such that 0.5 percent by weight≤Si≤1.5 percent by weight, an amount of aluminum Al, such that 0.1 percent by weight≤Al≤1.0 percent by weight, and the remainder iron, and incidental impurities of up to 200 ppm nitrogen, up to 400 ppm carbon, and up to 100 ppm oxygen, wherein the content of the elements chromium and manganese and molybdenum and aluminium and silicon and vanadium are such that 4.0 percent by weight≤(Cr+Mn+Mo+Al+Si+V)≤9.0 percent by weight;

wherein the alloy has a specific electrical resistivity ρ>0.50 μΩm, a yield strength $R_{p0.2}$>340 MPa, a saturation J(400 A/cm)>1.00 T, a coercive field strength $H_c$<3.5 A/cm and in its final annealed state has an elongation at rupture value of $A_L$>2%.

2. The soft magnetic core in accordance with claim 1, wherein 14 percent by weight≤Co≤22 percent by weight.

3. The soft magnetic core in accordance with claim 2, wherein 14 percent by weight≤Co≤20 percent by weight.

4. The soft magnetic core in accordance with claim 1, wherein 0 percent by weight≤V≤2 percent by weight.

5. The soft magnetic core in accordance with claim 1, wherein 0 percent by weight<Mo<0.5 percent by weight.

6. The soft magnetic core in accordance with claim 1, wherein the combined amounts of aluminium and silicon are such that 0.6 percent by weight≤Al+Si≤2 percent by weight.

7. The soft magnetic core in accordance with claim 1, wherein 6.0 percent by weight≤Cr+Mn+Mo+Al+Si+V≤9.0 percent by weight.

8. The soft magnetic core in accordance with claim 1, wherein the alloy in its final annealed state has an elongation at rupture value of $A_L$>20% under tensile testing.

9. The soft magnetic core in accordance with claim 1, wherein the alloy has a specific electrical resistivity of ρ>0.55 μΩm.

10. The soft magnetic core in accordance with claim 9, wherein the alloy has a specific electrical resistivity of ρ>0.60 μΩm.

11. The soft magnetic core in accordance with claim 10, wherein the alloy has a specific electrical resistivity of ρ>0.65 μΩm.

12. The soft magnetic core in accordance with claim 1, wherein the alloy has a saturation at J(400 A/cm)>2.00 T.

13. The soft magnetic core in accordance with claim 1, wherein the alloy has a coercive field strength $H_c$ of <2.0 A/cm.

14. The soft magnetic core in accordance claim 1, wherein the alloy has a maximum permeability of $\mu_{max}$>1000.

15. The soft magnetic core in accordance with claim 14, wherein the alloy has a maximum permeability of $\mu_{max}$>2000.

16. The soft magnetic core in accordance with claim 1, wherein the electromagnetic actuator is a solenoid valve of an internal combustion engine.

17. The soft magnetic core in accordance with claim 1, wherein the electromagnetic actuator is a fuel injection valve of an internal combustion engine.

18. The soft magnetic core in accordance with claim 1, wherein the electromagnetic actuator is a direct fuel injection valve of a spark ignition engine.

19. The soft magnetic core in accordance with claim 1, wherein the electromagnetic actuator is a direct fuel injection valve of a diesel engine.

20. A fuel injection valve of an internal combustion engine comprising a soft magnetic core in accordance with claim 1.

21. The fuel injection valve in accordance with claim 20, wherein the fuel injection valve is a direct fuel injection valve of a spark ignition engine.

22. The fuel injection valve in accordance with claim 20, wherein the fuel injection valve is a direct fuel injection valve of a diesel engine.

23. A soft magnetic stator for an electric motor comprising a soft magnetic alloy consisting essentially of:

an amount of cobalt Co, such that 10 percent by weight≤Co≤22 percent by weight, optionally an amount of vanadium V, such that 0 percent by weight≤V≤4 percent by weight, an amount of chromium Cr, such that 1.5 percent by weight≤Cr≤5 percent by weight, an amount of manganese Mn, such that 0.4 percent by weight≤Mn≤1 percent by weight, optionally an amount of molybdenum Mo, such that 0 percent by weight≤Mo≤1 percent by weight, an amount of silicon Si, such 0.5 percent by weight≤Si≤1.5 percent by weight, an amount of aluminum Al, such that 0.1 percent by weight≤Al≤1.0 percent by weight, and the remainder iron, and incidental impurities of up to 200 ppm nitrogen, up to 400 ppm carbon, and up to 100 ppm oxygen, wherein the content of the elements chromium and manganese and molybdenum and aluminium and silicon and vanadium are such that 4.0 percent by weight≤(Cr+Mn+Mo+Al+Si+V)≤9.0 percent by weight;

wherein the alloy has a specific electrical resistivity ρ>0.50 μΩm, a yield strength $R_{p0.2}$>340 MPa, a saturation J(400 A/cm)>1.00 T, a coercive field strength $H_c$<3.5 A/cm and in its final annealed state has an elongation at rupture value of $A_L$>2%.

24. A soft magnetic rotor for an electric motor comprising a soft magnetic alloy consisting essentially of:

an amount of cobalt Co, such that 10 percent by weight≤Co≤22 percent by weight, optionally an amount of vanadium V, such that 0 percent by weight≤V≤4 percent by weight, an amount of chromium Cr, such that 1.5 percent by weight≤Cr≤5 percent by weight, an amount of manganese Mn, such that 0.4 percent by weight≤Mn≤1 percent by weight, optionally an amount of molybdenum Mo, such that 0 percent by weight≤Mo≤1 percent by weight, an amount of silicon Si, such 0.5 percent by weight≤Si≤1.5 percent by weight, an amount of aluminum Al, such that 0.1 percent by weight≤Al≤1.0 percent by weight, and the remainder iron, and incidental impurities of up to 200 ppm nitrogen, up to 400 ppm carbon, and up to 100 ppm oxygen, wherein the content of the elements chromium and manganese and molybdenum and aluminium and silicon and vanadium are such that 4.0 percent by weight≤(Cr+Mn+Mo+Al+Si+V)≤9.0 percent by weight;

wherein the alloy has a specific electrical resistivity ρ>0.50 μΩm, a yield strength $R_{p0.2}$>340 MPa, a saturation J(400 A/cm)>1.00 T, a coercive field strength $H_c$<3.5 A/cm and in its final annealed state has an elongation at rupture value of $A_L$>2%.

25. A soft magnetic component for an electromagnetic valve adjustment system in an inlet and outlet valve used in an engine compartment comprising a soft magnetic alloy consisting essentially of:

an amount of cobalt Co, such that 10 percent by weight≤Co≤22 percent by weight, optionally an amount of vanadium V, such that 0 percent by weight≤V≤4 percent by weight, an amount of chromium Cr, such that 1.5 percent by weight≤Cr≤5 percent by weight, an amount of manganese Mn, such that 0.4 percent by weight≤Mn≤1 percent by weight, optionally an amount of molybdenum Mo, such that 0 percent by weight≤Mo≤1 percent by weight, an amount of silicon Si, such 0.5 percent by weight≤Si≤1.5 percent by weight, an amount of aluminum Al, such that 0.1 percent by weight≤Al≤1.0 percent by weight, and the remainder iron, and incidental impurities of up to 200 ppm nitrogen, up to 400 ppm carbon, and up to 100 ppm oxygen, wherein the content of the elements chromium and manganese and molybdenum and aluminium and silicon and vanadium are such that 4.0 percent by weight≤(Cr+Mn+Mo+Al+Si+V)≤9.0 percent by weight;

wherein the alloy has a specific electrical resistivity ρ>0.50 μΩm, a yield strength $R_{p0.2}$>340 MPa, a saturation J(400 A/cm)>1.00 T, a coercive field strength $H_c$<3.5 A/cm and in its final annealed state has an elongation at rupture value of $A_L$>2%.

26. A return part for an electromagnetic actuator comprising a soft magnetic alloy consisting essentially of:

an amount of cobalt Co, such that 10 percent by weight≤Co≤22 percent by weight, optionally an amount of vanadium V, such that 0 percent by weight≤V≤4 percent by weight, an amount of chromium Cr, such that 1.5 percent by weight≤Cr≤5 percent by weight, an amount of manganese Mn, such that 0.4 percent by weight≤Mn≤1 percent by weight, optionally an amount of molybdenum Mo, such that 0 percent by weight≤Mo≤1 percent by weight, an amount of silicon Si, such 0.5 percent by weight≤Si≤1.5 percent by weight, an amount of aluminum Al, such that 0.1 percent by weight≤Al≤1.0 percent by weight, and the remainder iron, and incidental impurities of up to 200 ppm nitrogen, up to 400 ppm carbon, and up to 100 ppm oxygen, wherein the content of the elements chromium and manganese and molybdenum and aluminium and silicon and vanadium are such that 4.0 percent by weight≤(Cr+Mn+Mo+Al+Si+V)≤9.0 percent by weight;

wherein the alloy has a specific electrical resistivity ρ>0.50 μΩm, a yield strength $R_{p0.2}$>340 MPa, a saturation J(400 A/cm)>1.00 T, a coercive field strength $H_c$<3.5 A/cm and in its final annealed state has an elongation at rupture value of $A_L$>2%.

27. A The return part in accordance with claim 26, wherein the electromagnetic actuator is a solenoid valve.

* * * * *